US007273463B2

(12) United States Patent
Priore

(10) Patent No.: US 7,273,463 B2
(45) Date of Patent: Sep. 25, 2007

(54) DYNAMIC GAUNTLET

(76) Inventor: Allan T. Priore, 1613 E. Michigan Ave., Kalamazoo, MI (US) 49048

( * ) Notice: Subject to any disclaimer, the term of this patent is extended or adjusted under 35 U.S.C. 154(b) by 645 days.

(21) Appl. No.: 10/730,706

(22) Filed: Dec. 8, 2003

(65) Prior Publication Data

US 2005/0124464 A1 Jun. 9, 2005

(51) Int. Cl.
*A61F 5/10* (2006.01)
*A63B 23/16* (2006.01)

(52) U.S. Cl. ..... 602/21; 601/40; 482/48; 2/163

(58) Field of Classification Search ..... 482/44, 482/47, 48; 602/21, 22; 601/40; 2/163, 2/168; 128/879, 880
See application file for complete search history.

(56) References Cited

U.S. PATENT DOCUMENTS 849,182 A * 4/1907 Adkins ..... 2/161.6
1,773,108 A * 8/1930 Lichty et al. ..... 128/880
2,108,236 A * 2/1938 Scott ..... 482/48
3,347,547 A * 10/1967 Hynes ..... 482/47
3,680,549 A * 8/1972 Lehneis et al. ..... 602/23
4,602,620 A 7/1986 Marx
4,615,522 A * 10/1986 Plough ..... 482/48
4,674,487 A * 6/1987 Schaeffer ..... 602/22
4,765,320 A 8/1988 Lindemann et al.
4,766,612 A * 8/1988 Patton, Sr. ..... 2/16
4,781,178 A * 11/1988 Gordon ..... 602/22
4,862,877 A * 9/1989 Barber ..... 602/22
4,949,711 A * 8/1990 Gyovai et al. ..... 602/21
5,095,897 A 3/1992 Clark et al.
5,261,393 A * 11/1993 Weinzweig ..... 601/40

(Continued)

FOREIGN PATENT DOCUMENTS

AU 9532910 A * 4/1996

(Continued)

OTHER PUBLICATIONS

North Coast Medical Hand Therapy Catalog, 2003-2004, pp. 41, 44 and 85.

(Continued)

*Primary Examiner*—(Jackie) Tan-Uyen Ho
*Assistant Examiner*—Victor K. Hwang
(74) *Attorney, Agent, or Firm*—Warner Norcross & Judd LLP

(57) ABSTRACT

A dynamic gauntlet including at least two of a base, a hand piece, and a thumb piece. At least one of the base, hand piece and thumb piece is constructed of an elastomeric material and includes an anchor having an attachment element extending toward the at least one other of the base, hand piece and thumb piece, which includes an attachment area. The attachment element is secured to the attachment area in a variety of pre-selected locations, thereby providing variable tension in the anchor to reconfigure the hand or digits. A method of the invention includes applying at least two of the base, the hand piece and the thumb piece to a wrist, arm or hand, and securing an anchor attachment element of one or more of these components to a pre-selected location on an attachment area of these components to reconfigure the hand or digits in a desired configuration.

16 Claims, 9 Drawing Sheets

U.S. PATENT DOCUMENTS

| | | | | | |
|---|---|---|---|---|---|
| 5,409,447 | A | * | 4/1995 | Wedge, Jr. | 601/40 |
| 5,447,490 | A | * | 9/1995 | Fula et al. | 601/40 |
| 5,697,103 | A | * | 12/1997 | Wiggins | 2/159 |
| 5,762,621 | A | | 6/1998 | Schultz | |
| 5,857,990 | A | | 1/1999 | Maas | |
| 5,876,363 | A | | 3/1999 | Marx | |
| 5,921,945 | A | * | 7/1999 | Gray | 602/5 |
| 5,928,172 | A | | 7/1999 | Gaylord | |
| 5,971,945 | A | * | 10/1999 | Garris | 602/21 |
| 6,059,694 | A | * | 5/2000 | Villepigue | 482/47 |
| 6,063,087 | A | | 5/2000 | Agee et al. | |
| 6,093,162 | A | | 7/2000 | Fairleigh et al. | |
| 6,238,358 | B1 | | 5/2001 | Philot et al. | |
| 6,371,932 | B1 | | 4/2002 | Foote | |
| 6,450,924 | B1 | * | 9/2002 | Block | 482/48 |
| 6,454,681 | B1 | | 9/2002 | Brassil et al. | |
| 6,565,563 | B1 | | 5/2003 | Agee et al. | |
| 7,001,352 | B2 | * | 2/2006 | Farrell et al. | 602/21 |
| 7,135,006 | B1 | * | 11/2006 | Weber et al. | 602/22 |
| 2003/0195093 | A1 | * | 10/2003 | White | 482/124 |
| 2006/0149180 | A1 | * | 7/2006 | Phelen | 602/20 |
| 2006/0211964 | A1 | * | 9/2006 | Farrell et al. | 602/5 |
| 2006/0276735 | A1 | * | 12/2006 | Phelen et al. | 602/21 |

FOREIGN PATENT DOCUMENTS

| | | |
|---|---|---|
| WO | 2004/019812 | 3/2004 |

OTHER PUBLICATIONS

Smith+Nephew 2002 Splinting Products Catalog, pp. 46, 55 and 61.

* cited by examiner

DYNAMIC GAUNTLET

BACKGROUND OF THE INVENTION

The present invention relates to therapeutic devices and, more particularly, to dynamic systems that apply variable forces on the hand for therapy or rehabilitation.

Many injuries, diseases and neurological disorders affect the hand or digits, for example, by deforming the hand or digits, by decreasing the range of motion of the hand or digits, or by inhibiting muscular, structural or neurological function of the hand or digits. Individuals afflicted with such conditions often experience pain, discomfort, inhibited hand or digit function, and undesired attention when their hand or digits are deformed by such conditions. Moreover, diseases or injuries affecting the hand typically create a disability that is far more limiting than afflictions of other body parts.

Accordingly, a number of rigid, passive force splints have been developed to address these conditions. An example of a conventional hand splint is found in U.S. Pat. No. 4,949,711 to Gyovai, which discloses an outrigger including a pulley system, mounted to a rigid plastic splint that encapsulates the hand and wrist. Finger slings are positioned on each finger, and rigging is strung from the slings, over the pulley system, toward the wrist. The wrist end of the rigging is attached to the splint with a touch fastening system, which, when adjusted reconfigures the fingers by extending only the metacarpal phalangeal joint.

Although conventional hand splints like the one in Gyovai provide some relief, they are bulky, awkward and tend to draw unwanted attention to the hand and wearer. Frequently, the sheer size of the outrigger structure makes it impractical to wear the hand splint when engaging in everyday activities. Furthermore, because the hand splint is rigid, other portions of the hand cannot be adjusted when the splint is worn. Moreover, it is possible for the outrigger and/or rigging to "catch" on items, which creates a safety hazard for the wearer. These stated issues decrease the wearing compliance of rigid splints. Additionally, given the relatively fixed spatial configuration of the pulley systems, such hand splints typically are incapable of reforming the fingers except along very specific, single lines of force. Thus, the functionality of the hand is markedly diminished.

SUMMARY OF THE INVENTION

The aforementioned problems are overcome in the present invention comprising a dynamic therapeutic and rehabilitative gauntlet. The gauntlet includes at least two of a hand piece, which includes digit elements that receive digits of a wearer, a base secured to the wrist and/or arm, and a thumb piece secured to the thumb of a wearer. At least one of the hand piece, base and thumb are constructed of an elastomeric material and include one or more elastomeric anchors, each including an attachment element, that extends toward another component. At least one of the hand piece, the base, and the thumb piece include an attachment area complimentary to the attachment element. The attachment elements may be releasably secured to any desired location on the attachment area to provide a desired tension in the elastomeric anchors, which in turn reconfigures the hand and/or digits.

In another embodiment, the entire hand piece, including the digit elements, is constructed from a single piece of elastomeric material. The material includes strips that are spiraled and secured along edges of the strips to form tubular structures, which receive the digits of a wearer.

In yet another embodiment, the present invention provides a method generally including: securing a base to at least one of a wrist and an arm; securing to a digit a first piece including a common piece and a digit element, at least one of the base and the first piece including an anchor having an attachment element, the other of the first piece and the base including an attachment area; releasably securing the attachment element at a pre-selected location on the attachment area to provide a tension in the elastomeric anchor. The tension is transmitted to the hand and/or digit to reconfigure the same. In an aspect of this embodiment, the first piece may be the hand piece and/or the thumb piece.

The dynamic gauntlet of the present invention is user-friendly and easily adjusted. The gauntlet enables a user to efficiently restore the natural shape, arch and function to the hand and/or digits—frequently without the aid of a therapist or healthcare provider—simply by selectively positioning the anchors and applying a desired tension to the hand and/or digits. Because the components of the gauntlet are constructed from an elastomeric material, which provides the desired tension, the gauntlet is void of bulky outriggers, pulley systems and/or vulnerable outrigger lines. In turn, the gauntlet is very low profile, almost unnoticeable, and safe for a user to wear in everyday activities. Moreover, because it is modular, it is much more easily donned than an outrigger splint. Additionally, it is possible to manipulate the various anchors of the gauntlet so that they act in concert to provide multiple, combined vector forces on the hand and/or digit to provide a desired reconfiguration.

These and other objects, advantages and features of the invention will be more readily understood and appreciated by reference to the detailed description of the invention and the drawings.

DETAILED DESCRIPTION OF THE INVENTION

I. Overview

Figure 1:
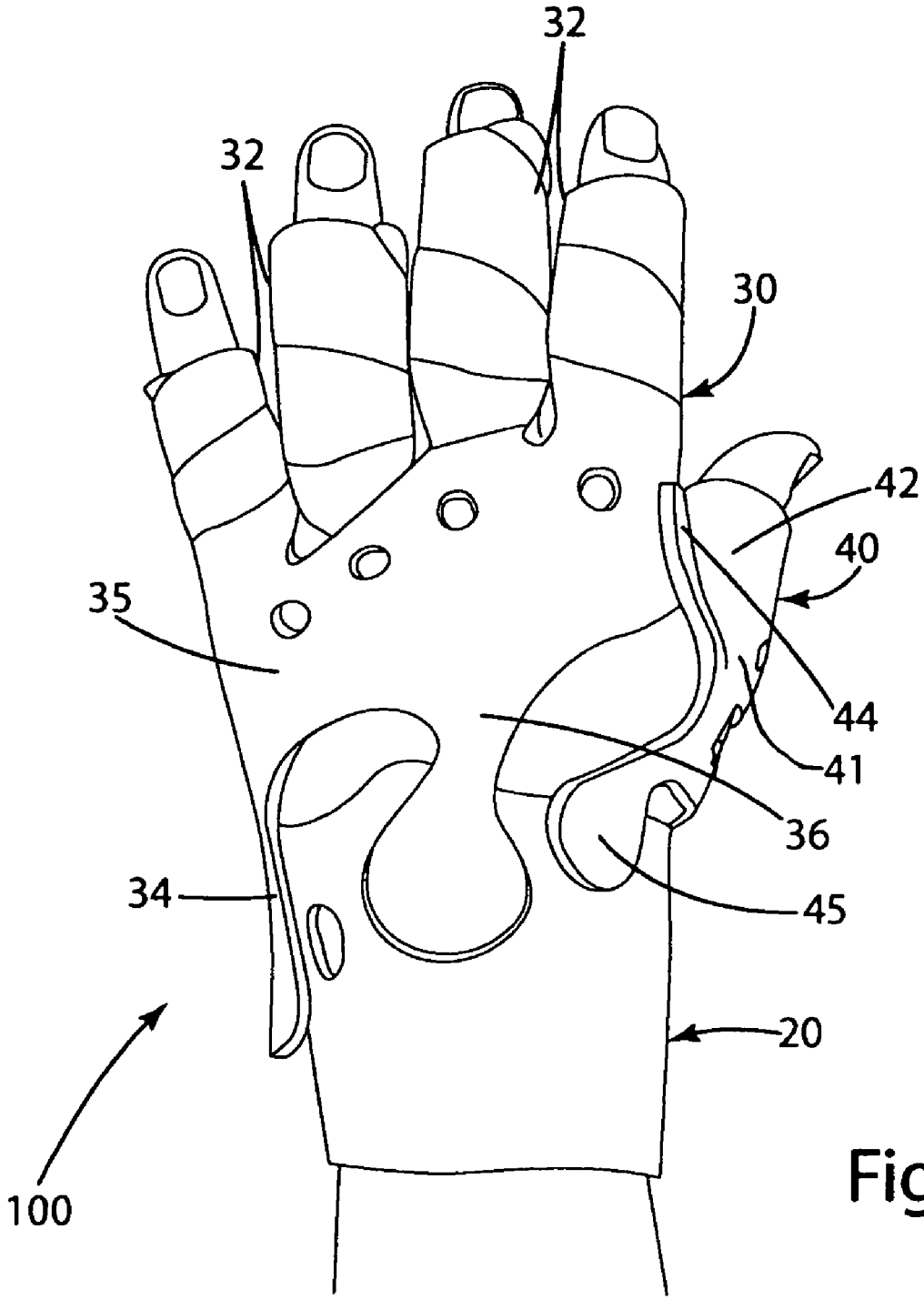
FIG. 1 is a perspective view of the gauntlet of the present invention applied to a human hand.
Figure 2:
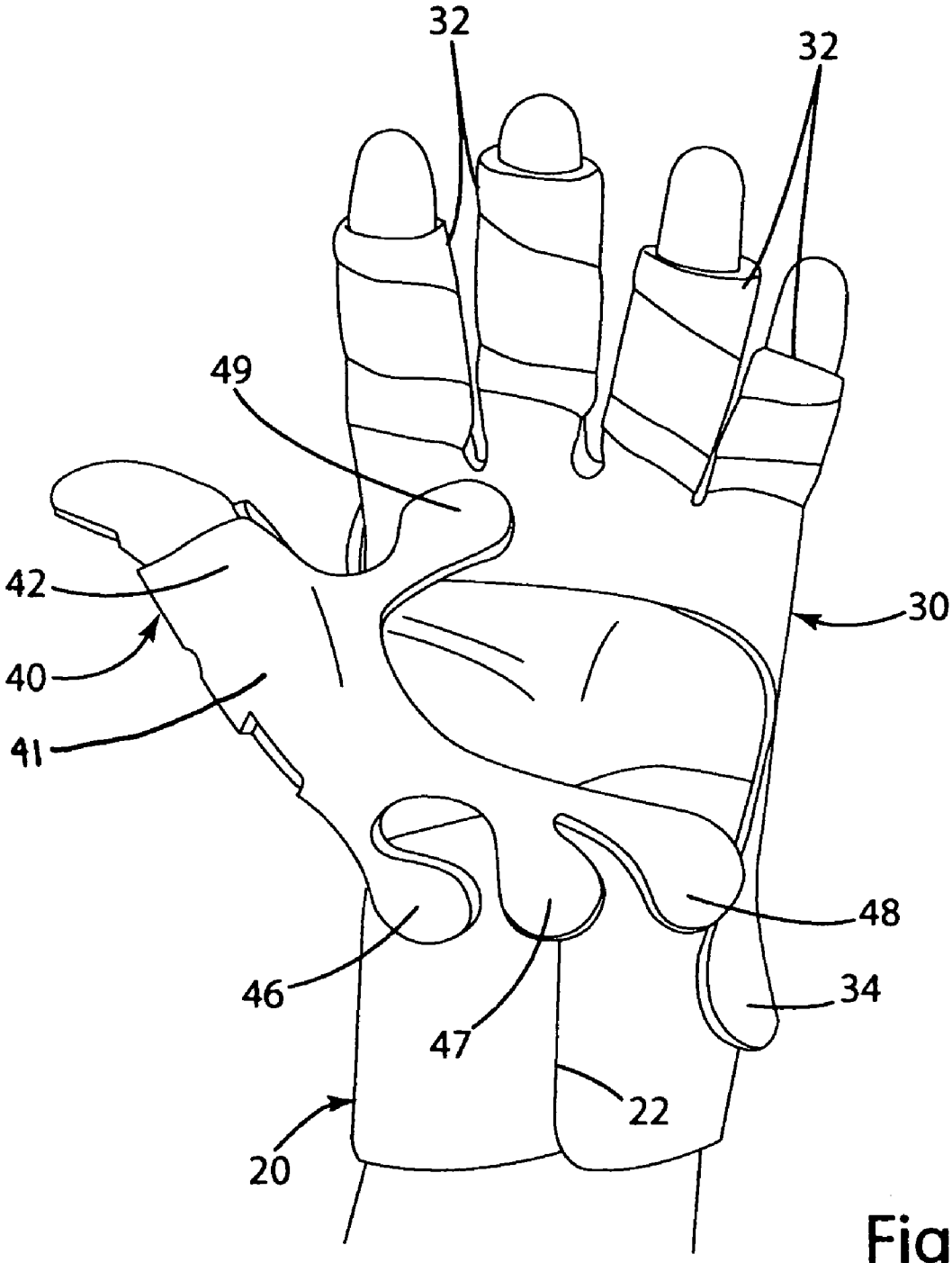
FIG. 2 is a perspective view of the gauntlet from the palmer side of the hand.

A therapeutic and rehabilitative gauntlet constructed in accordance with an embodiment of the present invention is shown in FIGS. 1 and 2 and generally designated 100. The gauntlet includes at least two of a base 20, a hand piece 30 and a thumb piece 40. One or more of the base, hand and thumb pieces are constructed of an elastomeric material. The hand piece 30 includes digit elements 32, also referred to as finger elements, and anchors 34 and 36. The thumb piece 40 includes a digit element 42, also referred to as a thumb element, and thumb anchors 44-49. Each anchor includes an attachment element 33, 43 (FIG. 6), which enables the anchor to be releasably secured to the other pieces or base. Accordingly, each anchor may be secured at pre-selected locations on the other pieces or base. In this manner, a user may adjust the tension(s) in the anchor(s), thereby reconfiguring the hand and/or digits.

Figure 3:
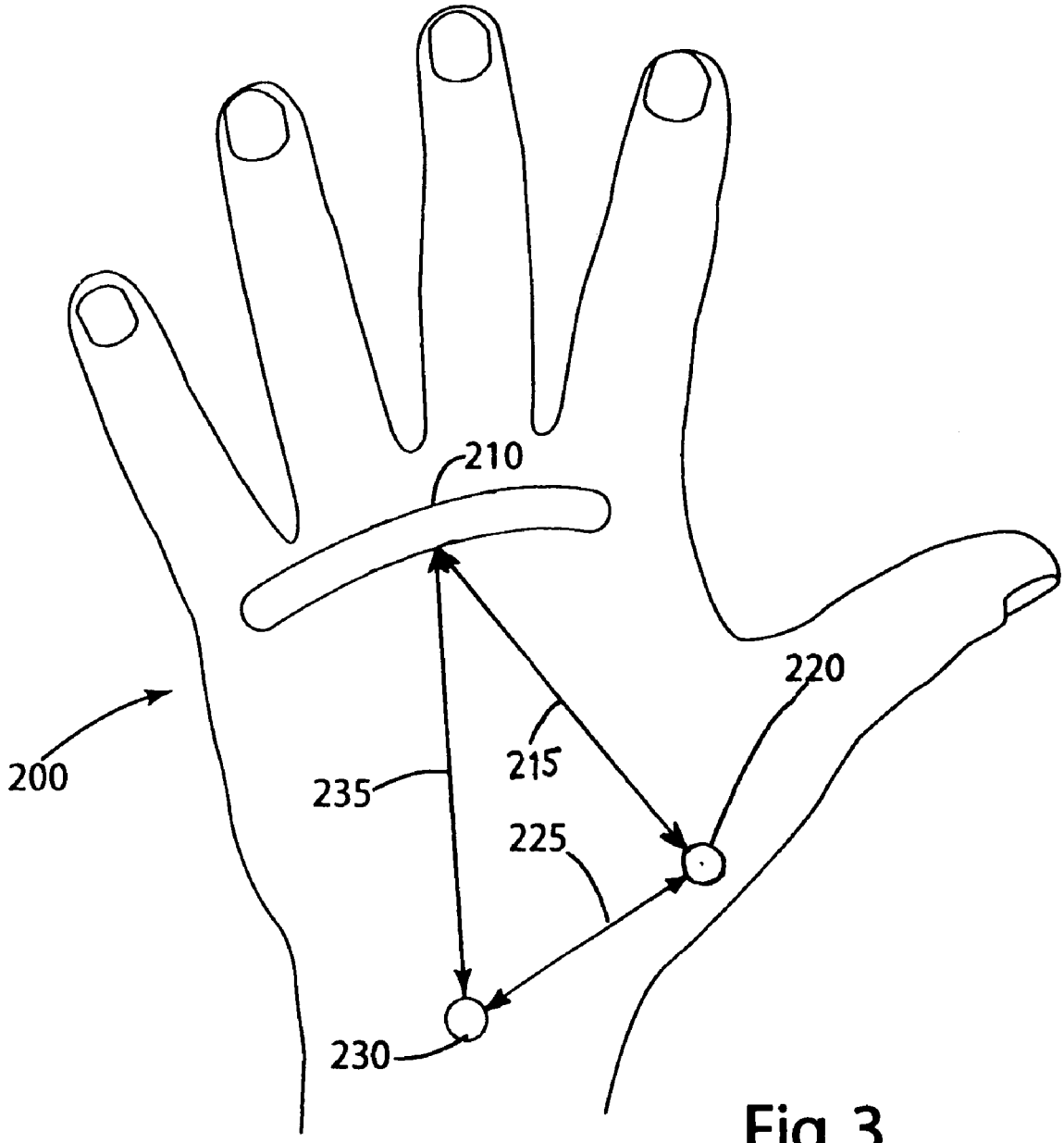
FIG. 3 is a top view of the cornerstones of movement of the hand.

To better illustrate the invention, a brief background and definition of relevant descriptive terms relating to the hand is useful. Referring to FIG. 3, the mechanics of the hand 200 is based on three cornerstones of movement: the wrist cornerstone 230; the metacarpal phalangeal joints 2-5 (i.e., one or more joints at the base of the fingers), also referred to as the finger cornerstone 210, and metacarpal phalangeal joint 1 (i.e., the joint at the base of the thumb), also referred to as the thumb cornerstone 220. The inventor has discovered that the hand is reconfigured with extraordinary efficiency by manipulating or modifying the spatial relationship between cornerstones 210, 220 and 230. This spatial relationship includes the angles between lines 215, 225 and 235, the orientation of the plane or planes within which the cornerstones are disposed, and/or the distances between cornerstones 210, 220 and 230. When the spatial relationships are fixed, the hand and/or digits may be precisely splinted for a desired therapy or rehabilitation. To adjust the angles and/or distances, forces are exerted on the cornerstones. For example, when tension is transmitted along line 235, between the finger cornerstone 210 and the wrist cornerstone 230, depending on which side of the hand tension is exerted, the hand will either open or close. As another example, if tension is transmitted along line 225 between cornerstone 220 and 230, the thumb will rotate.

As used herein, the proximal side of the hand refers to the portion of the hand near the wrist. The radial side of the hand is the thumb side of the hand, and the ulnar side refers to the side of the hand away from the thumb. The palmer portion of the hand is the inside of the hand at the palm, and the dorsal side of the hand is the back of the hand.

II. Gauntlet Construction

With further reference to FIGS. 1 and 2, the gauntlet 100 and components thereof will now be described in more detail. The gauntlet 100 includes a base 20, which is designed to be attached to the wrist, the arm, or more specifically, the forearm. As shown, the base is generally to be shaped to fit around the extremity and includes a seam 22. The base may be sewn together at the seam to form a tube that fits over the hand of the wearer onto the wrist and/or forearm. Optionally, the base 20 may be constructed of a strip of material including fasteners that fasten opposing ends of the strip together, for example, snaps, a touch fastening system such as Velcro® straps with D-rings, a Velcro® system, a resealable adhesive, or other conventional fasteners.

As shown, the base is positioned close enough to the hand so that the anchors of the other pieces attach to the base. Optionally, the base is positioned so that it is associated with the wrist cornerstone of the hand.

Figure 6:
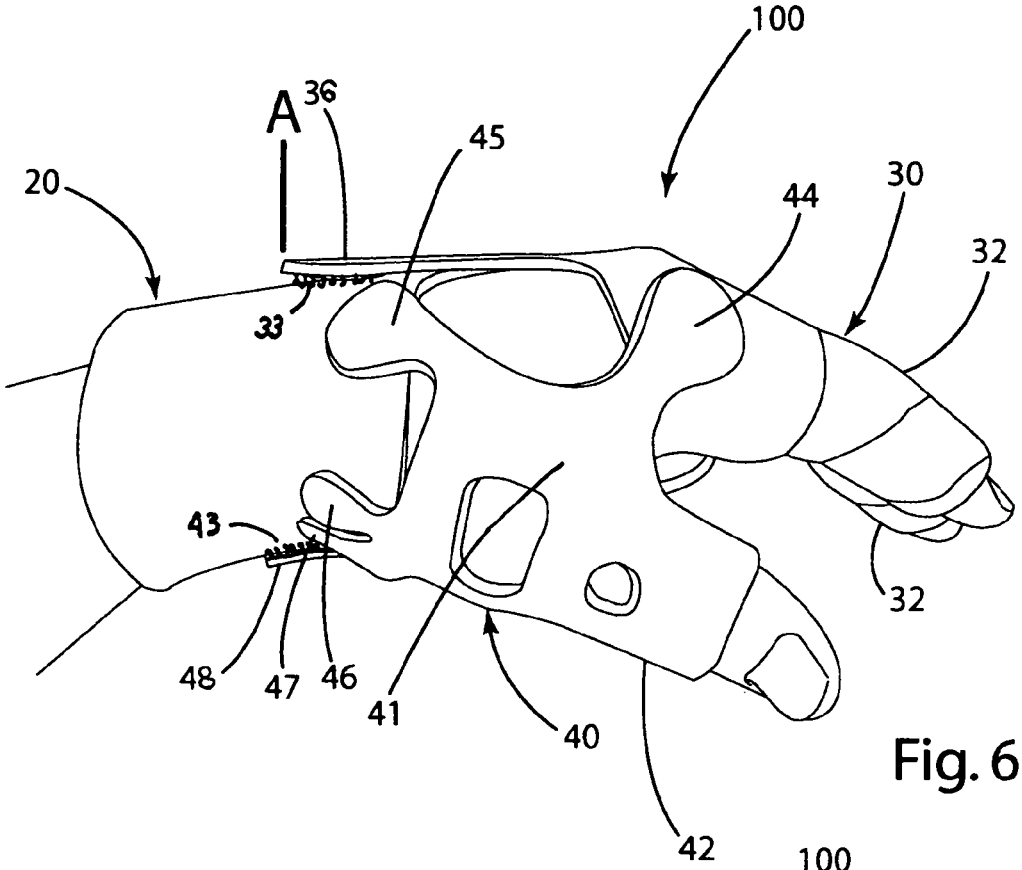
FIG. 6 is a side view of the gauntlet applied to a hand with a deformity before reconfiguration.

The exterior of the base 20 includes one or more attachment areas that enable the anchors of the other pieces to attach at specific locations on the base. For example, the base or areas thereon may include snaps, hooks or the like, which compliment other attachment elements secured to the ends of the anchors. Optionally, the exterior of the base is covered with a fabric that may be used as the fibrous looped portion of a touch fastening system, for example, Velcro®, while the interior surface of the base may be covered with a soft stretchable fabric. As shown in FIG. 6, the base includes a fibrous exterior attachment area to which Velcro® attachment elements 33, 43 attach, however, separate independent attachment areas may be secured to the base as desired. Materials suitable for forming the base include materials such as neoprene, rubber laminates, and/or materials with one side having a fibrous loop or similar surface, however, other materials such as cloth, plastic or rubber may be used as desired. The material optionally may be perforated to improve airflow to the hand, and thus prevent maceration of the skin.

Referring again to FIGS. 1 and 2, the gauntlet 100 includes a hand piece 30, which includes multiple digit elements 32, specifically referred to as finger elements. The digit elements 32 are connected to a common piece 35. The common hand piece 35, digit elements 32 and anchors 34 and 36 may be multiple components secured together, or a single integral piece. The hand piece 30 is constructed and secured to the hand so that it is associated with the finger cornerstone.

In a specific embodiment, the digit elements 32 are tubular and adapted to receive fingers therein and constructed so that when applied to a digit, they at least partially extend the finger, specifically, they at least partially extend at least one of the proximal interphalangeal joints, the distal interphalangeal joint, and the metacarpal phalangeal joint of the digit. To achieve this tubular construction, pieces of material may be secured together with seams parallel to the finger, or long strips of material may be spiral wound to form tubular digit elements 32. When spiral wound, abutting edges of the strips are secured together with stitching, cement, adhesives or other fastening materials. Optionally, the strips are wound so that the seams do not restrict extension of the distal interphalangeal joint, the proximal interphalangeal joint, or the metacarpal phalangeal joint. Further optionally, the manner in which these spiral-wound strips are secured together may add a circumferential force either in the direction of interphalangeal flexion or extension depending on the desired therapeutic outcome, or they may be wound to have no net force effect on the interphalangeal joints. Additionally, when spiral wound strips are used to form the digit elements 32 and the digit elements 32 are further connected to the common hand piece element 35, the entire hand piece 30 may be constructed from a single integral piece of material.

Materials suitable for forming the hand piece 30 include materials such as neoprene, rubber laminates, and/or materials with one side having a fibrous loop or similar surface, however, other materials such as cloth, plastic or rubber may be used as desired.

As shown, the common piece 35 circumferentiates the hand 200, wrapping substantially around the palmer and dorsal sides of the hand. In certain applications, such complete circumferentiation is unnecessary. Moreover, in some applications, some digit elements may be absent as desired.

The anchors 34 and 36 extend from the common piece 35 on the dorsal and ulnar sides of the hand. The specific location of these anchors, and lines of extension from the common piece 35 may vary as the application requires. The anchors 34 and 36 are integral with or secured to the common piece 35 at one end, and include at an opposite end attachment elements 33 (FIGS. 6 and 7) which are adapted to be releasably secured to an attachment area on the base 20 or thumb piece 40. The anchors 34 and 36 are constructed from a stretchable elastomeric material, which provides tension between the finger cornerstone and the wrist cornerstone when the anchors are attached to the base 20. The tension in the anchors may be adjusted by positioning the ends of the anchors at pre-selected locations to stretch the remainder of the anchor and provide the required tension on the common piece 35, which in turn modifies the spatial relationship between the finger cornerstone and the wrist cornerstone and reconfigures the hand and/or the digits. Incidentally, when the common piece 35 is under tension, the digit elements 32, by their securement to the common piece, are under tension as well, which reconfigures the digits.

The gauntlet shown in FIGS. 1 and 2 includes an optional thumb piece 40. The thumb piece 40 includes a digit element 42, referred to as a thumb element, and multiple anchors 44-48. The thumb element 42 is generally tubular in shape and adapted to receive the thumb therein. The thumb element 42 may at least partially extend the thumb and joints thereof in the manner described above in connection with finger elements 32. The thumb piece 40 may also be constructed of the same materials as the hand piece 30 or the base 20. The thumb piece 40 may optionally include apertures that promote movement of the thumb when received by the thumb piece 40. Where the thumb piece 40 is absent from the gauntlet, optional permanent linkage pieces or anchors may join the hand piece 30 and the base 20 on one or both sides of the thumb, i.e., on the dorsal and palmer side of the hand adjacent the thumbs. This configuration may prevent ulnar deviation caused by anchor 34.

The anchors of the thumb piece 44-49 are similar to hand piece anchors 34 and 36. For example, the thumb piece anchors 44-49 each include a first end secured to or integral with the thumb common piece 41, and an opposite end including attachment element 43 (FIG. 6), which enables the end to be secured to the hand piece 30 and the base 20 at pre-selected locations. Anchors 45-48 may be aligned with line 225 between the thumb cornerstone 220 and the wrist cornerstone 230 (FIG. 3). Anchors 44 and 49 may be aligned with line 215, between the finger cornerstone 210 and the thumb cornerstone 220, respectively.

The various anchors of the gauntlet are described above as being joined with particular pieces i.e., the hand piece and thumb piece at one end and releasably secured to base at another end. However, the ends of the anchors may be joined with or releasably attached to any of the thumb piece, hand piece or base as desired. Likewise attachment areas may be associated with any of the thumb piece, hand piece or base as desired. For example, instead of the anchors 34 and 36 being joined with the hand piece 30 and releasably attached to the base 20, the anchors may be joined with the base 20 and releasably attached to an attachment area on the hand piece 30. Likewise, the anchors of the thumb piece 40 may be associated with the base 20 and/or hand piece 30 and joined with one or more attachment areas on the thumb piece 40. In general, the anchors may extend from one component and releasably attach to another component provided that the anchors enable reconfiguration and/or splinting of the hand and/or digits.

Furthermore, the base 20 and the pieces 30 and 40 may be used in varying combinations. For example, for certain therapy, only the base 20 and thumb piece 40 are required. For other therapy, only the hand piece 30 and thumb piece 40 are required.

III. Method of Use

A method of using the gauntlet 100 of the present invention will now be described with reference to FIGS. 3-10. Fundamentally, the gauntlet of the present invention manipulates the tension along lines 215, 225 and 235, between the respective finger cornerstone 210 and the thumb cornerstone 220, the thumb cornerstone 220 and the wrist cornerstone 230, and the wrist cornerstone 230 and the finger cornerstone 210, as shown in FIG. 3. Accordingly, the spatial relationship between the cornerstones is modified and the hand and/or digits are reconfigured.

In general, each component of the gauntlet is associated with a cornerstone, i.e., the hand piece 30 is associated with the finger cornerstone 210, the base 20 is associated with the wrist cornerstone 230, and the thumb piece 40 is associated with the thumb cornerstone 220. By releasably securing the ends of the anchors of the pieces to corresponding attachment areas on the hand piece, the base or the thumb piece, the elastomeric material of the anchor is stretched to provide a specific tension therein. The tension in the anchors is transmitted to the respective pieces to reconfigure the hand and/or digits. Reconfiguration may occur by inducing the hand and/or digits to flex and/or extend in various configurations. Examples of hand reconfigurations using the gauntlet 100 follow.

Figure 4:
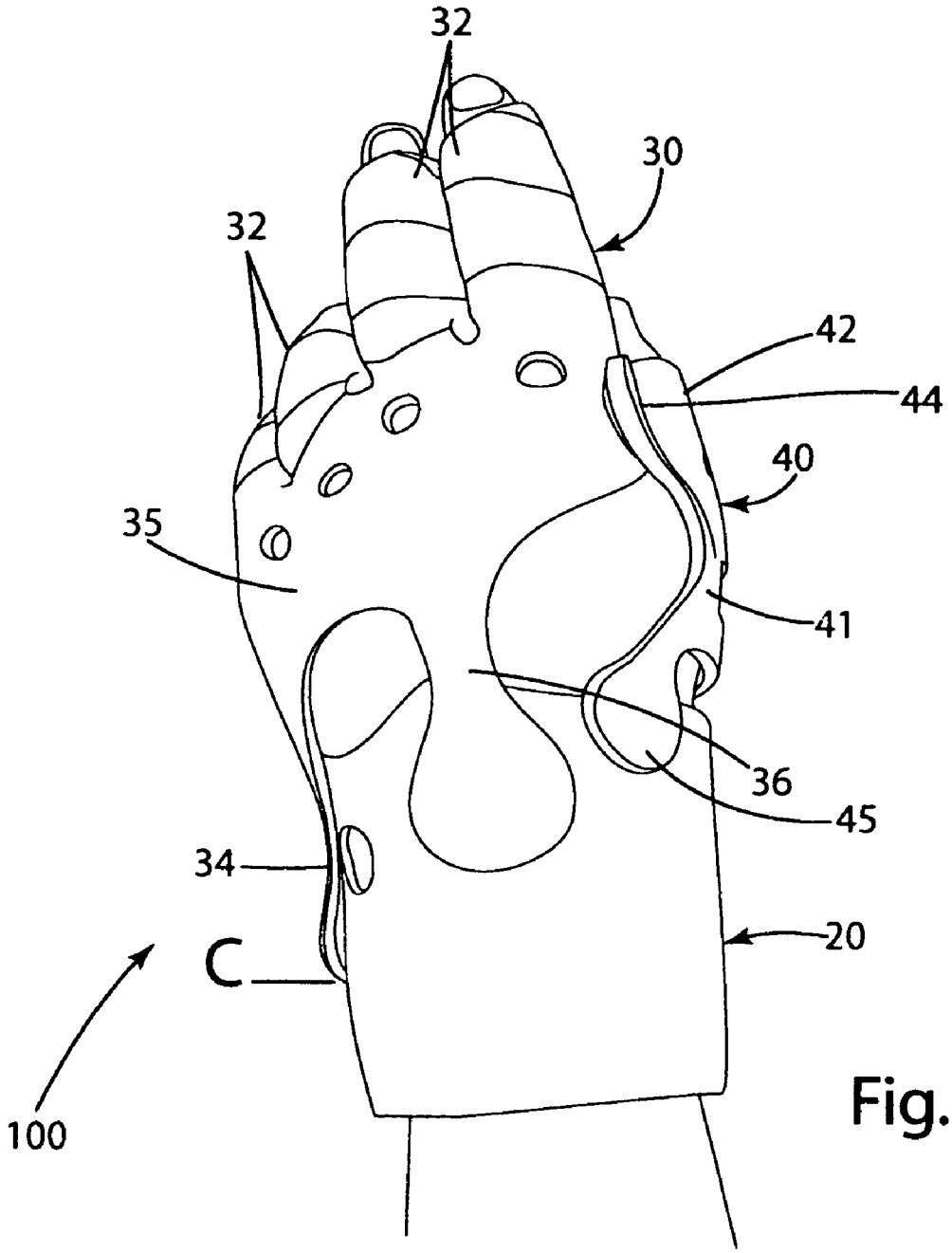
FIG. 4 is a top view of the gauntlet applied to a hand with a neurological disorder before reconfiguration.
Figure 5:
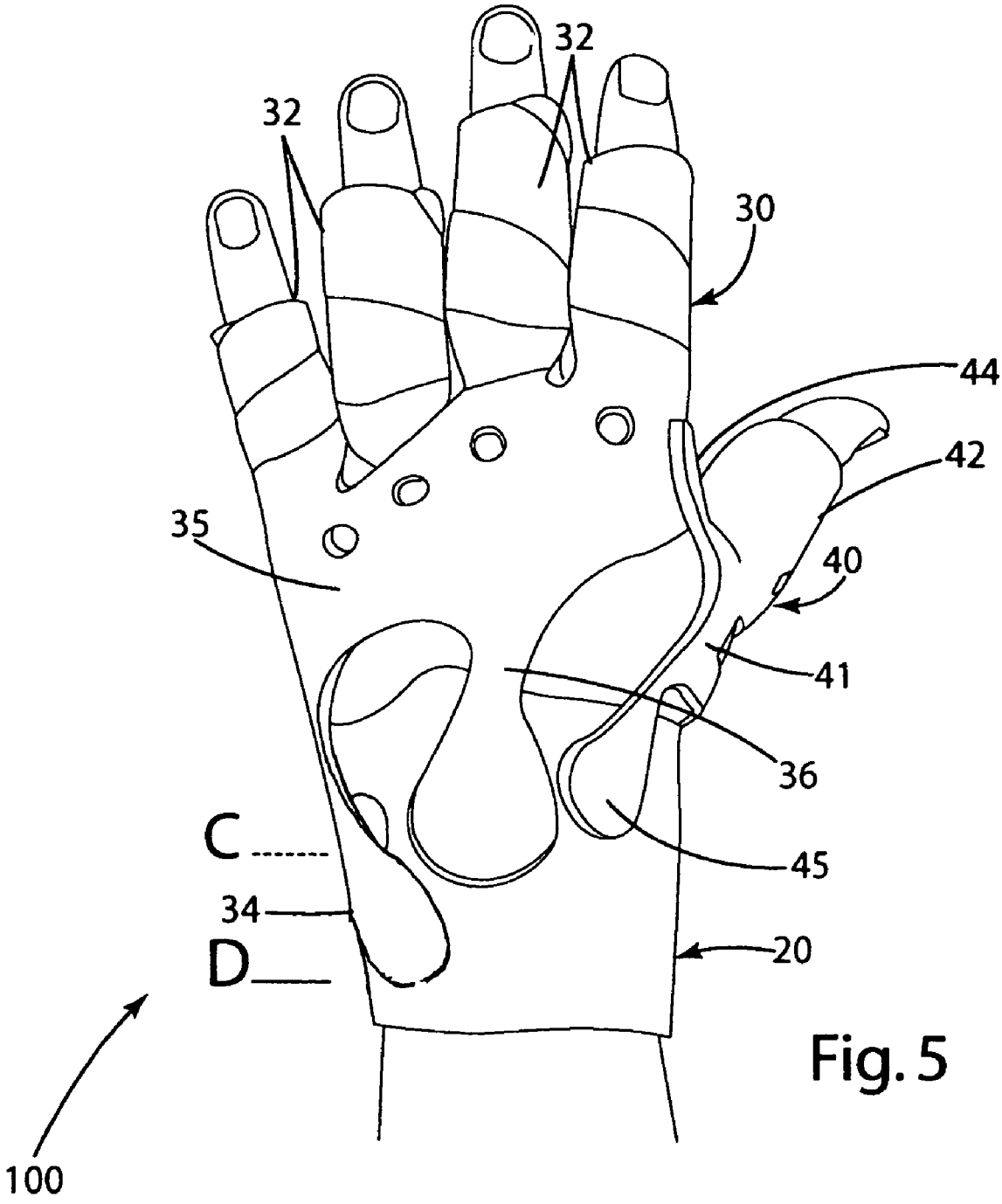
FIG. 5 is a top view of the gauntlet reconfiguring the hand to compensate for the neurological disorder.

FIG. 4 illustrates a hand of a subject afflicted with a nerve disorder that causes flexion of the proximal interphalangeal and distal interphalangeal joints of the middle, ring and pinky fingers so that those fingers curl toward the palmer side of the hand. In use, the gauntlet 100 is applied to the digits, i.e., the fingers and the thumb and the wrist. The anchors 34 and 36 of the hand piece 30 are loosely fastened to the base 20 for fitting. As shown, the ulnar anchor 34 is initially attached to the base at position C. To correct the deformity, i.e., the curling of the fingers toward the palm, the ulnar anchor 34 is detached from the base 20 and reattached at position D as shown in FIG. 5. This causes the anchor 34 to stretch along its length and transmit the tension to the ulnar side of the common piece 35, which transmits the tension to finger elements 32 and pulls the pinky, ring and middle fingers to a splinted, generally extended configuration. Once reconfigured, the hand no longer appears deformed.

In general, FIG. 6 illustrates a hand of a subject who is afflicted with a nerve disorder that causes all the fingers to flex and curl inward toward the palmer side of the hand in a "claw-like" configuration. By adjusting the dorsal side anchor 36 from position A to position B, the tension in the anchor is adjusted and is transmitted to the digit elements 32, thereby straightening the digits in the direction of the arrow in FIG. 7 to reconfigure the hand. This and similar adjustments of the dorsal side anchor 36 also reconfigures the hand to the position shown in FIG. 7 if, in addition to the fingers, the palm curled toward the wrist in FIG. 6.

A specific example of a possible nerve affliction depicted in FIG. 6 and the corrective actions shown in FIG. 7 will now be described. In FIG. 6, the injured hand may be afflicted with a nerve disorder that prevents the muscles from properly functioning, which in turn causes several conditions that deform the hand. First, the hand flattens out by losing its natural arches. Without movement, the muscles begin to atrophy. The thumb may also be limited to flexion and extension, but will not be able to abduct, adduct, position or reposition. The wrist may also flex with any attempt the subject makes to extend the proximal interphalangeal or distal interphalangeal joints of digits 2-5. The digits may also assume the shape of a "claw" at rest, and in effect, the subject will be unable to adduct or abduct digits 2-5.

Figure 7:
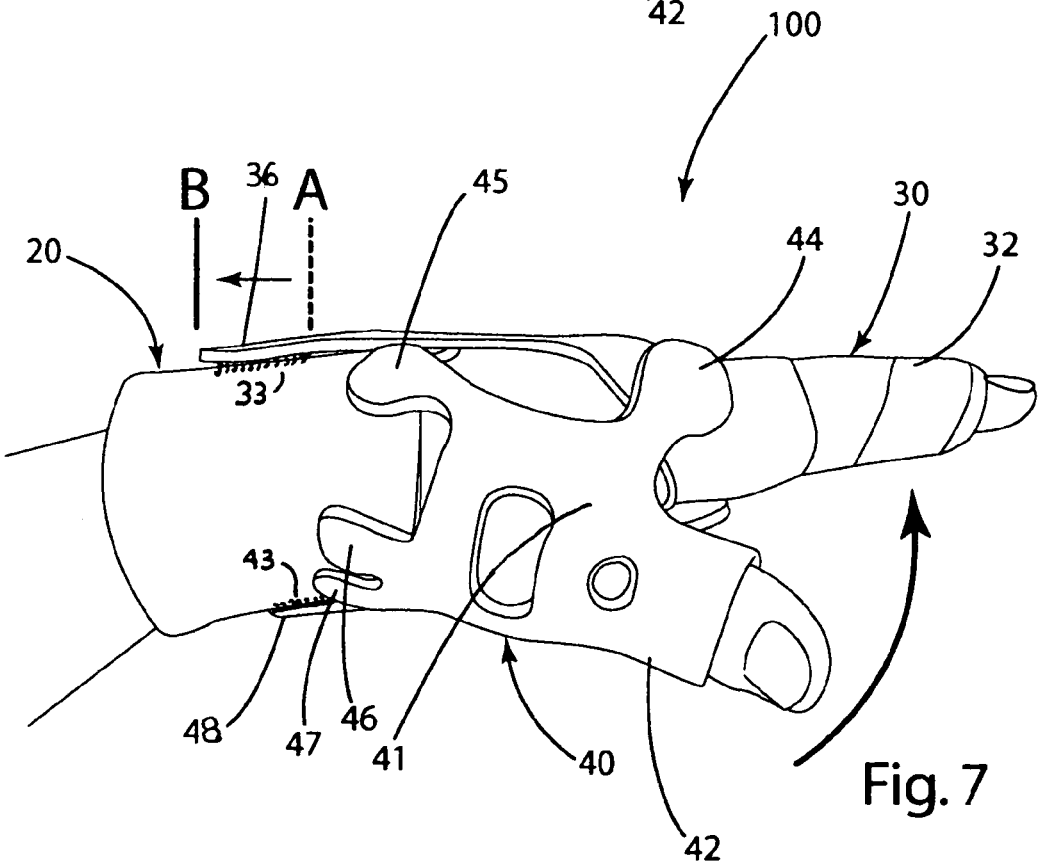
FIG. 7 is a side view of the gauntlet reconfiguring the hand to correct the deformity.

The gauntlet in FIG. 7 may be reconfigured to correct the above conditions caused by the nerve disorder. For example, by re-anchoring anchors 34, 36 and 45, the wrist of the subject is repositioned at about 20° to about 30° of extension, and the proximal interphalangeal and distal interphalangeal joints 2-5 are extended. By repositioning anchors 46-49, the thumb is abducted. Also by repositioning anchors 34 and 49, digits at metacarpals 2-5 are flexed. The spiral configuration of the finger elements may also act to flex the digits. Thus, with the assistance of the gauntlet, the hand is rendered functional and ready to hold and manipulate objects as desired.

Figure 8:
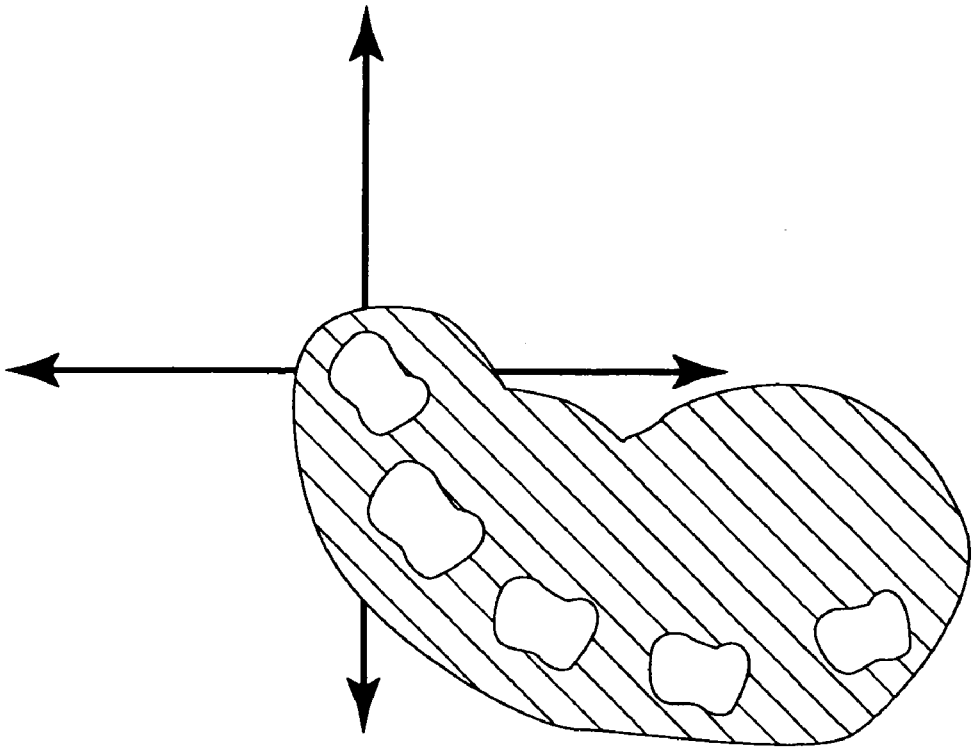
FIG. 8 is a first sectional view of the hand showing reconfiguration of the thumb using the gauntlet.
Figure 9:
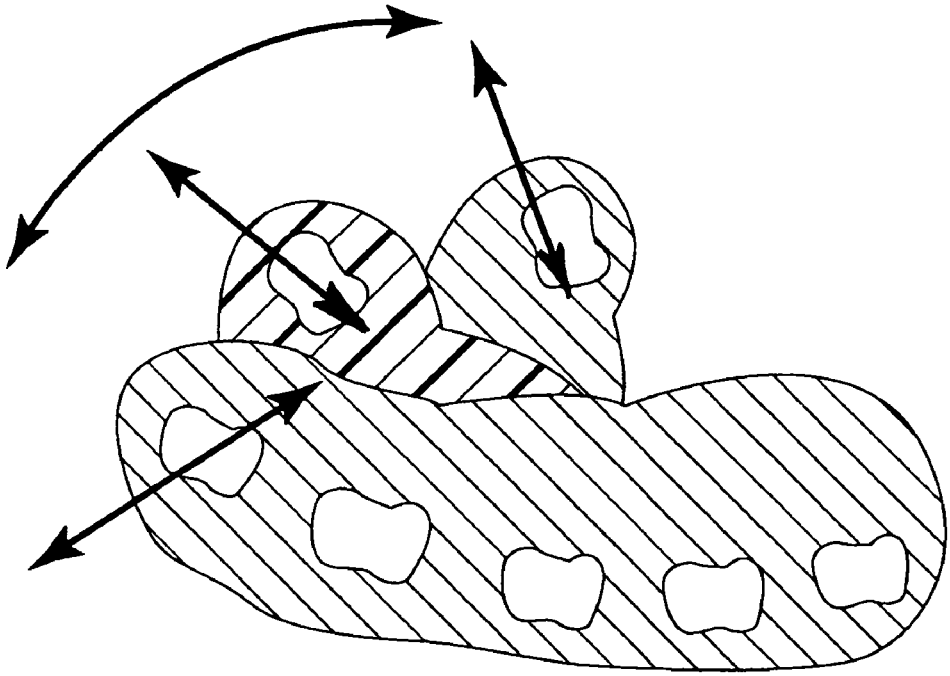
FIG. 9 is a second sectional view of the hand showing reconfiguration of the thumb using the gauntlet.
Figure 10:
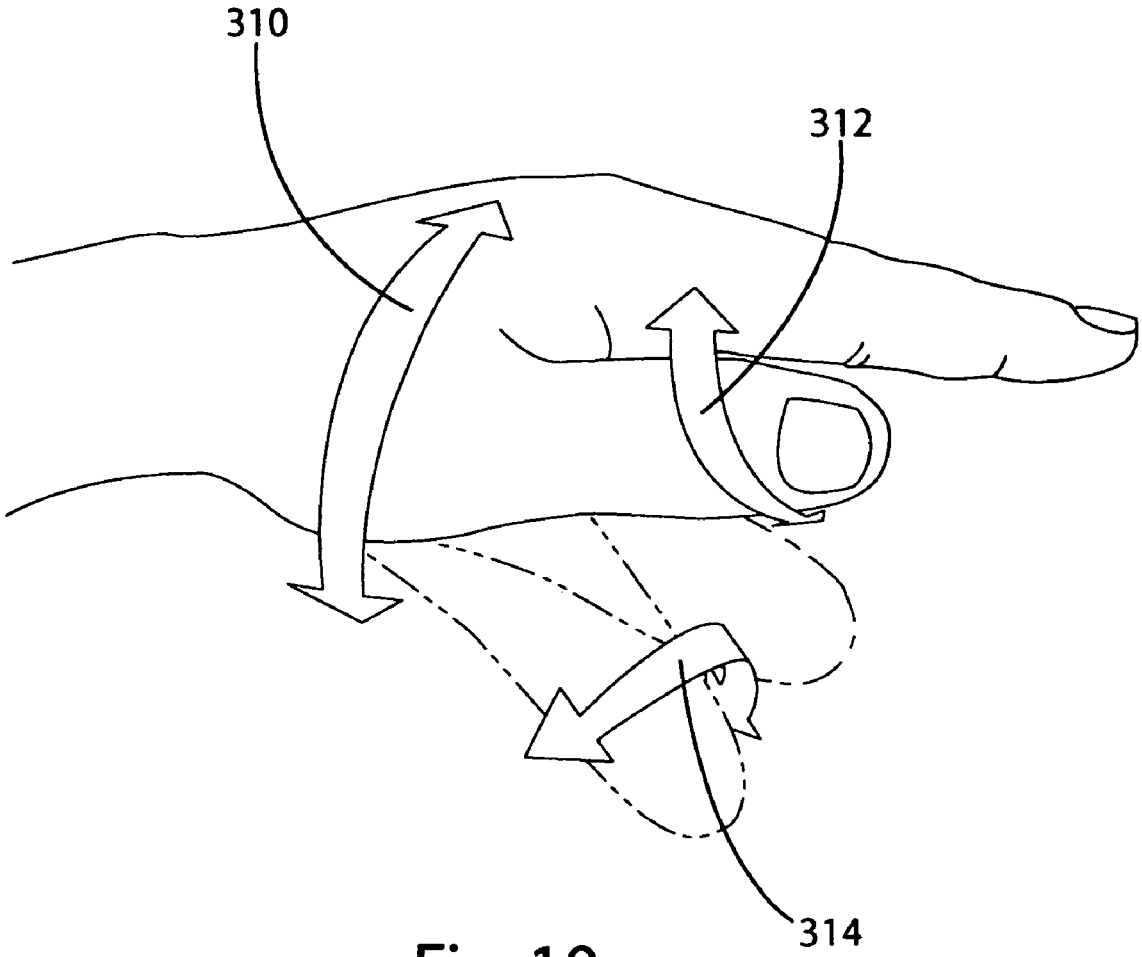
FIG. 10 is a side view of a hand showing reconfiguration of the thumb using the gauntlet.

FIGS. 8-10 illustrate the use of the thumb piece 40 to reconfigure the thumb. In general, by attaching the anchors 45-48 at the specific locations on the base 20, the thumb may be reconfigured relative to the hand and/or wrist or other digits in any of the directions shown with arrows in FIGS. 8 and 9. Incidentally, FIGS. 8 and 9 show a transverse cross section of a left hand at the level of the thumb metacarpal phalangeal joint in an anatomical position. A side view of possible reconfigurations of the thumb available when using the gauntlet (which is not shown for the sake of simplicity) is illustrated in FIG. 10. For example, to move the thumb in direction 312, anchor 44 (FIG. 1) is attached to the hand piece 30 more toward the ulnar side of the hand to create increased tension within the anchor 44, while anchor 49 (FIG. 2) is positioned closer to the radial side of the hand to create less tension in anchor 49. In short, the anchors of the thumb piece 40 may be adjusted in any manner desired to reconfigure the thumb in direction 310, 312, 314 or other directions as the application requires.

It has been observed that modifying the triangulated configuration of the three cornerstones in one or more dimensions allows for an enormous variety of possible modifications of the hand. In addition to modifying the spatial relationship of the three cornerstones, the net effect of such modification can yield many different results other than those stated above. For example, referring to FIG. 3, increasing tension along line 235 extends the wrist as well as the digits. In another example, it is possible to reestablish the transverse arch of the hand by securing an anchor (not shown) between the palmer side of thumb piece 41 to the hand piece at the pinky finger. In yet another example, it is possible to correct palmer deviation by increasing tension between the hand piece and the base with anchors 45 and 46 being positioned further "up" the wrist (FIG. 6). Many other modifications are possible with the gauntlet of the present invention.

Figure 11:
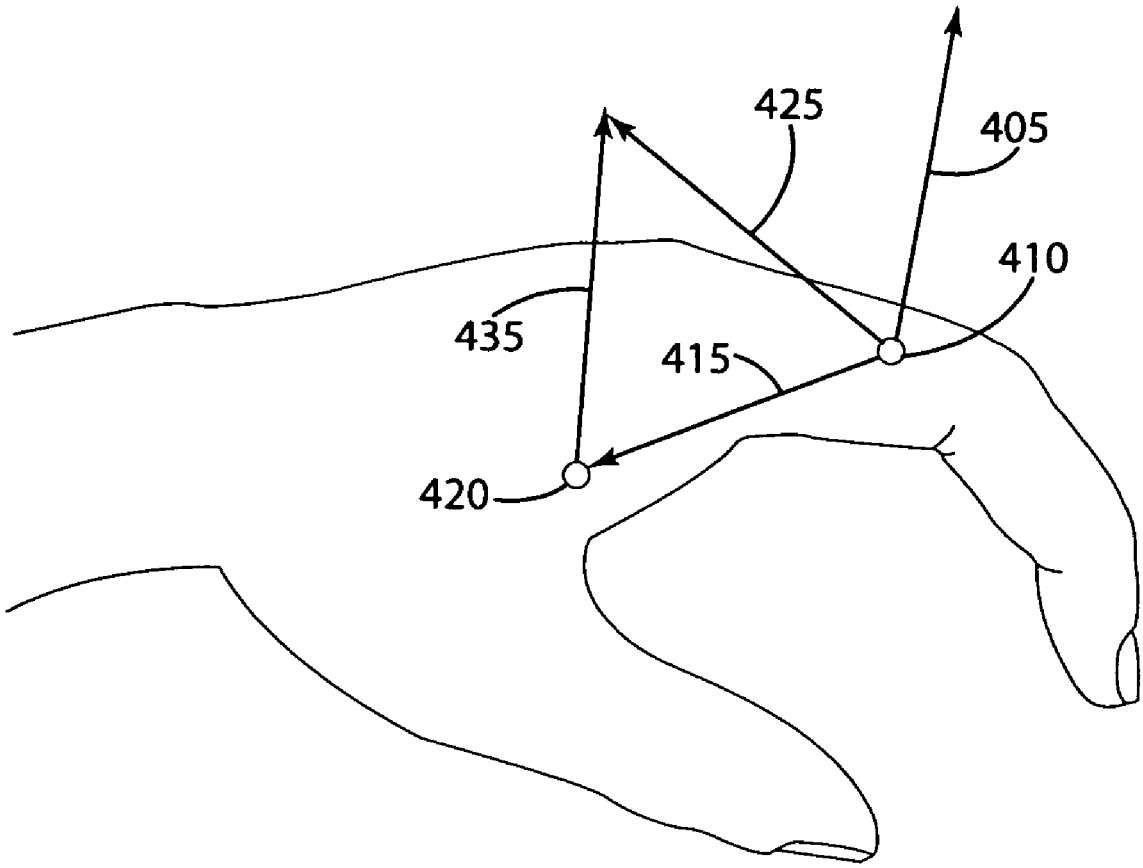
FIG. 11 is a side view of a hand reconfigured using combined vector forces provided by the gauntlet.

It has been observed that the gauntlet of the present invention optionally exerts multiple forces on the hand and/or digits. When these forces are combined, they provide a net force that reconfigures the hand and/or digits in a manner that is significantly more efficient than that of conventional outriggers, which utilize only a single force to reconfigure digits. For example, with reference to FIG. 11, the single force 405 is exerted by a conventional outrigger (not shown) including a pulley positioned above the knuckles of the hand, a finger sling wrapped around the finger and an outrigger line strung over the pulley to the finger sling pulling upward on the finger. Accordingly, the conventional outrigger only exerts a single force 405 along a single line, i.e., that coincident with the outrigger line. In this configuration, the single force 405 is intended to extend the metacarpal phalangeal joint so that the finger is in an extended position.

The dynamic gauntlet of the present invention may reconfigure a hand and/or digits using a combination of multiple forces, e.g., forces 425 and 415. In effect, the combined forces 425 and 415 exert the same force in the same direction as the single force 405 provided by a conventional outrigger. As an example, single force 405 is applied with a conventional outrigger to position 410 to exert a force of 45 units of force in the direction shown, thereby extending metacarpal phalangeal metacarpal 2. By comparison, using the gauntlet of the present invention, two forces 425 and 415 are applied to position 410 to yield the same net extension effect as single force 405. Specifically, force 425 is applied by positioning anchor 36 on the base 20 (FIG. 1) at a position sufficient to exert a force of 60 units of force that pull acutely on the finger at position 410. Force 415 is simultaneously applied to position 410 by extending an anchor between the hand element 30 and the base 20 (FIG. 2). For example, anchor 49 acting in combination with the remainder of the thumb piece 40 provides a net force of 30 units of force pulling on position 410 in the direction of force 415. Adding the forces, 425 and 415 yields a resultant force 435 of 45 units of force, which is equal to the force provided by single force 405. Moreover, the resultant combined vector forces 415 and 425, by virtue of their combination, are coincident with the line of the force 405. An added benefit of using the combined forces of the gauntlet is that as the finger extends, the resultant force 435 maintains it orientation.

The above description of how the gauntlet exerts combined forces on the hand and/or digits is for illustrative purposes only. It is noted that the gauntlet is capable of exerting any number of forces and/or combined forces on the hand and/or digits.

The therapeutic gauntlet of the present invention has a unique low profile due to the use of elastomeric materials in certain components. Additionally, with the selectively positionable anchors of the gauntlet, users may restore normal shape and/or function to their hands using minimal effort, and frequently without the assistance of a therapist or other healthcare provider.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A dynamic gauntlet comprising:

a base adapted for securement to at least one of a wrist and an arm of a wearer; and a flexible hand piece including a plurality of tubular finger elements, each tubular finger element receiving and at least partially extending or flexing a finger, said hand piece including a common piece connecting said plurality of finger elements, at least one of said base and said common piece constructed of an elastomeric material and including an anchor having a hook-and-loop attachment element extending toward the other of said base and said common piece, the anchor originating distal from each tubular finger element, the other of said base and said common piece including a hook-and-loop attachment area, complimentary to said attachment element, wherein the attachment element is releasably positioned at any one of a plurality of different positions on the attachment area to provide a plurality of different tensions in the anchor, thereby reconfiguring at least one of the fingers and the hand of the wearer, wherein the base and flexible hand piece are separate components, joined substantially only by the attachment element, wherein each of the base and flexible hand piece are adapted to be separately donned by the wearer.

2. The dynamic gauntlet of claim 1 wherein the hand piece includes an anchor extending toward the base on the dorsal side of the hand.

3. The dynamic gauntlet of claim 1 wherein the hand piece includes an anchor adapted to be positioned on the ulnar side of the hand and extending toward the base on the ulnar side of the hand.

4. The dynamic gauntlet of claim 1 comprising a thumb piece adapted to be secured to the thumb and separate from the hand piece.

5. The dynamic gauntlet of claim 4 wherein the thumb piece includes a secondary anchor including a secondary attachment element that is releasably positioned at a pre-selected position on the attachment area to provide tension in the secondary anchor, thereby reconfiguring the thumb.

6. The dynamic gauntlet of claim 4 wherein the hand piece includes a secondary attachment area and wherein at least one of the hand piece and the thumb piece includes a secondary anchor including a secondary attachment element that is releasably positioned at a pre-selected position on the secondary attachment area to provide tension in the secondary anchor thereby reconfiguring the thumb.

7. The dynamic gauntlet of claim 1 wherein the anchor includes a first end fixedly joined with at least one of the hand piece and the base and a second end that includes the attachment element, said second end releasably positioned adjacent said other of said hand piece and said base.

8. A therapeutic gauntlet comprising:

a base adapted to be secured to at least one of an arm and a wrist, said base including a plurality of different attachment points, said base associated with a wrist cornerstone of the hand;

extending means for at least partially extending a digit of a hand, said extending means associated with at least one of a thumb cornerstone of the hand and a finger cornerstone of the hand;

tension means for providing a pre-selected tension on said extending means to reconfigure at least one of the digit and the hand, said tension means constructed substantially only from an elastomeric material; and attachment means for releasably attaching said tension means to at least one of the plurality of different attachment points on said base, wherein attachment of the tension means at different attachment points adjusts the tension transmitted through said tension means to said extending means, wherein at least one of the digit and the hand is reconfigured in a selected splinting position, whereby the spatial relationship between at least two of the wrist cornerstone and the at least one of the thumb cornerstone and the finger cornerstone is modified, wherein the base is physically separated from said extending means by a distance, wherein the tension means provides the only connection between the extending means and the base, wherein the base and extending means are adapted to be separately donned by a wearer on the hand.

9. A therapeutic gauntlet of claim 8 wherein the extending means is tube-shaped and adapted to receive a digit.

10. A therapeutic gauntlet of claim 8 wherein the extending means includes a hand piece and a thumb piece, the hand piece including a plurality of finger elements that each receive a finger, the thumb piece including a thumb element that receives a thumb.

11. A therapeutic gauntlet of claim 10 wherein the tension means extends from at least one of the hand piece and the thumb piece toward the base.

12. A therapeutic gauntlet of claim 8 wherein the extending means extends the proximal interphalangeal joint of at least one of a finger and a thumb in a substantially extended configuration.

13. A therapeutic gauntlet of claim 8 wherein the extending means is a hand piece including at least one digit element.

14. A dynamic gauntlet comprising:

a base adapted for securement to at least one of a wrist and an arm of a wearer; and a flexible hand piece including a plurality of finger elements, each finger element receiving and at least partially extending or flexing a finger, said hand piece including a common piece connecting said plurality of finger elements, at least one of said base and said common piece constructed of an elastomeric material and including an anchor having an attachment element extending toward the other of said base and said hand piece, the other of said base and said hand piece including an attachment area, complimentary to said attachment element, wherein the attachment element is releasably positioned at a pre-selected position on the attachment area to provide a tension in the anchor, thereby reconfiguring at least one of the fingers and the hand of the wearer, wherein at least one of the plurality of finger elements is constructed of a strip of elastomeric material spiraled to form a tube within which a finger is disposed.

15. A therapeutic gauntlet comprising:

a base adapted to be secured to at least one of an arm and a wrist, said base including a plurality of attachment points, said base associated with a wrist cornerstone of the hand;

extending means for at least partially extending a digit of a hand, said extending means associated with at least one of a thumb cornerstone of the hand and a finger cornerstone of the hand;

tension means for providing a pre-selected tension on said extending means to reconfigure at least one of the digit and the hand, said tension means constructed substantially only from an elastomeric material; and attachment means for releasably attaching said tension means to at least one of the plurality of attachment points on said base, wherein attachment of the tension means at different attachment points adjusts the tension transmitted through said tension means to said extending means, wherein at least one of the digit and the hand is reconfigured in a selected splinting position, whereby the spatial relationship between at least two of the wrist cornerstone and the at least one of the thumb cornerstone and the finger cornerstone is modified, wherein the extending means is constructed of a strip of said elastomeric material spiraled to form a tube that substantially surrounds a portion of the digit.

16. A dynamic gauntlet comprising:

a base adapted to be secured to at least one of an arm and a wrist, said base associated with a wrist cornerstone of the hand;

a plurality of digit elements adapted to be at least partially extending a digit of the hand, said digit elements associated with at least one of a thumb cornerstone of the hand and a finger cornerstone of the hand;

a common piece connected to said plurality of finger elements, but separated a distance from said base;

a plurality of anchors joined directly with at least one of the base and the common piece, each anchor including an attachment element adapted to engage a plurality of different attachment points associated with the other of the at least one of the base and the common piece, wherein attachment of the plurality of anchors to the plurality of different attachment points adjusts the tension transmitted through the anchor to the common piece and the digit elements, wherein at least one of the digit elements and the hand is reconfigured in a selected splinting position, wherein the plurality of anchors include at least one anchor on the dorsal side of the hand and another anchor on the ulnar side of the hand.

* * * * *